US005704854A

United States Patent [19]

Higuchi et al.

[11] Patent Number: 5,704,854

[45] Date of Patent: Jan. 6, 1998

[54] THREE-PIECE SOLID GOLF BALL

[75] Inventors: Hiroshi Higuchi; Hisashi Yamagishi, both of Chichibu, Japan

[73] Assignee: Bridgestone Sports Co., Ltd., Tokyo, Japan

[21] Appl. No.: 667,733

[22] Filed: Jun. 21, 1996

[30] Foreign Application Priority Data

Jun. 23, 1995 [JP] Japan ..... 7-180978

[51] Int. Cl.[6] ..... A63B 37/08; A63B 37/12

[52] U.S. Cl. ..... 473/373; 473/374; 473/351

[58] Field of Search ..... 473/374, 375, 473/376, 370, 351

[56] References Cited

U.S. PATENT DOCUMENTS 5,439,227 8/1995 Egashira et al. ..... 473/374 X

*Primary Examiner*—George J. Marlo

*Attorney, Agent, or Firm*—Sughrue, Mion, Zinn, Macpeak & Seas, PLLC

[57] ABSTRACT

In a three-piece solid golf ball comprising a center core, an intermediate layer and a cover. The center core is based on rubber, the intermediate layer is formed mainly of a thermoplastic polyester elastomer to a Shore D hardness of 30–55, and the cover is formed mainly of an ionomer resin to a Shore D hardness of 45–54. The cover has a thickness in the range of 1.0–3.0 mm, the intermediate layer has a thickness of 0.5–3.0 mm and the core a thickness of 30–41 mm. The intermediate layer has a specific gravity of at least 1.05. The golf ball has spin receptivity approximate to wound golf balls while maintaining superior flight and durability characteristic of solid golf balls.

10 Claims, 1 Drawing Sheet

THREE-PIECE SOLID GOLF BALL

BACKGROUND OF THE INVENTION

1. Field of the Invention

This invention relates to a three-piece solid golf ball and more particularly, to a three-piece solid golf ball which has spin receptivity approximate to wound golf balls while maintaining the superior flight and durability characteristic of solid golf balls.

2. Prior Art

Golf balls of various structures are currently on the market. Among others, two-piece solid golf balls and thread-wound golf balls share the majority of the market. The two-piece solid golf ball has a rubber based core and an enclosing cover typically of ionomer resin while the thread-wound golf ball is produced by winding thread rubber around a solid or liquid center and enclosing the center with a cover.

Most amateur golfers are fond of two-piece solid golf balls which have excellent flying performance and durability although these balls have the disadvantages of a very hard feel on hitting and low control due to quick separation from the club head on hitting.. For this reason, many professional golfers and skilled amateur golfers prefer wound golf balls to two-piece solid golf balls. The wound golf balls are superior in feeling and control, but inferior in carry and durability to the two-piece solid golf balls. Under the present situation that two-piece solid golf balls and wound golf balls have contradictory characteristics as mentioned above, players make a choice of golf balls depending on their own skill and preference.

In order to develop solid golf balls having a hitting feel approximate to the wound golf balls, the inventors proposed new types of three-piece solid golf balls in Japanese Patent Application Kokai (JP-A) Nos. 142228/1994, 24084/1995, and 24085/1995. More particularly, JP-A 142228/1994 and 24084/1995 disclose a three-piece solid golf ball having a hard cover and featuring an improved total balance of flight, durability and feeling. The three-piece solid golf ball of JP-A 24085/1995 provides a low spin rate on driver shots, but a high spin rate on approach shots. Upon iron shots, these balls are less controllable since their spin receptivity is lower than wound golf balls. On short iron shots, the balls will fly too far. The three-piece solid golf balls of the above-mentioned patent references are improved in feel, but still leave room to improve spin properties.

SUMMARY OF THE INVENTION

An object of the invention is to provide a three-piece solid golf ball which has spin receptivity approximate to wound golf balls so that it may gain more spin on iron shots and improved controllability while maintaining superior flight and durability characteristic of solid golf balls.

Regarding a three-piece solid golf ball comprising a center core based on rubber, an intermediate layer and a cover, we have found that when the intermediate layer is formed mainly of a thermoplastic polyester elastomer to a Shore D hardness of 30 to 55 degrees, and the cover is formed mainly of an ionomer resin to a Shore D hardness of 45 to 58 degrees, quite unexpectedly, spin receptivity is improved close to wound golf balls while maintaining superior flight and durability characteristic of solid golf balls. The golf ball is imparted more spin on iron shots, ensuring better control.

More particularly, the great difference in spin between the solid golf ball and the wound golf ball does not arise from the difference of cover material, but from their internal structure. The solid golf ball has a uniform internal structure composed mainly of a rubber base whereas the internal structure of the wound golf ball is highly resilient and non-uniform in that thin thread rubber is wound on a liquid or solid core numerous turns. The difference in uniformity of internal structure between the solid golf ball and the wound golf ball leads to a difference in spin therebetween. According to the present invention, an intermediate layer based on a soft thermoplastic polyester elastomer is formed around the center core and a cover based on an ionomer resin which is softer than in the prior art, but not too soft is formed around the intermediate layer, thereby achieving a more uniform structure. It is generally believed that a ball of such uniform structure will have a low spin rate and poor control and that improvements in spin and control are incompatible with the maintenance of flight and durability. Nevertheless, we have found that when the intermediate layer is formed mainly of a thermoplastic polyester elastomer to a Shore D hardness of 30 to 55 degrees, and the cover is formed mainly of an ionomer resin to a Shore D hardness of 45 to 58 degrees, spin receptivity is improved close to wound golf balls that professional golfers favor while maintaining superior flight and durability characteristic of solid golf balls. The spin properties of the ball do not differ among different types of clubs. A high spin rate is obtained even with an iron. There is obtained a three-piece solid golf ball having improved spin, flight, durability and feel.

Because of the more uniform structure mentioned above, the three-piece solid golf ball of the invention is of high quality and minimized variation and thus best suited for tournament pros who require a high precision of repetition.

BRIEF DESCRIPTION OF THE DRAWING

The only figure.

DETAILED DESCRIPTION OF THE INVENTION

Figure 1:
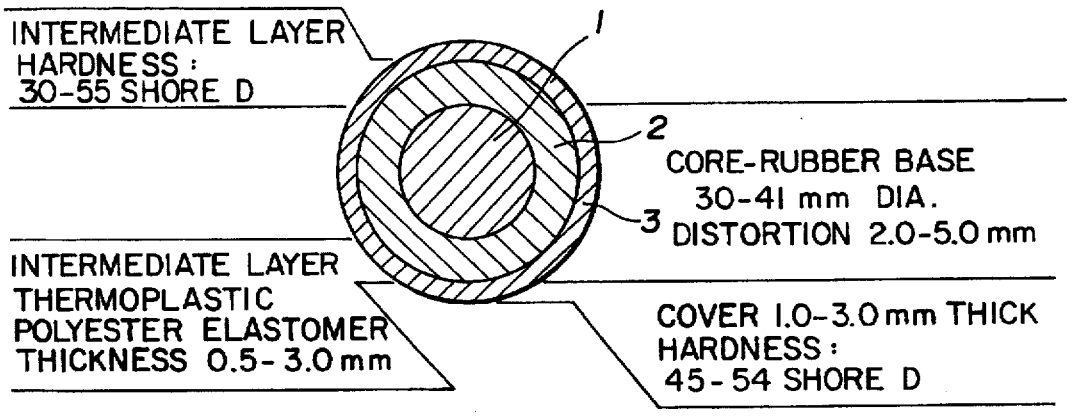
FIG. 1 is a schematic cross section of a three-piece solid golf ball according to the invention.

Referring to FIG. 1, there is schematically illustrated a typical three-piece solid golf ball according to the invention. The ball includes a spherical center core 1, an intermediate layer 2 enclosing the core 1, and a cover 3 enclosing the intermediate layer 2. According to the invention, the intermediate layer 2 disposed between the center core 1 and the cover 3 is soft, and the cover 3 is soft, but not too soft.

The center core 1 is formed mainly of a rubber base, typically natural rubber and/or synthetic rubber as used in conventional solid golf balls. In the practice of the invention, 1,4-polybutadiene having at least 40% of cis structure is especially preferred. The polybutadiene may be blended with natural rubber, polyisoprene, and styrene-butadiene rubber, if desired.

Preferably the center core has a distortion of 2.0 to 5.0 mm, more preferably 2.2 to 4.8 mm under a load of 100 kg. Also preferably the center core has a diameter of 30 to 41 mm, especially 33 to 39 mm.

The intermediate layer 2 has a hardness of 30 to 55, preferably 32 to 54 on a Shore D scale and is formed mainly of a thermoplastic polyester elastomer. With a Shore D hardness of less than 30 degrees, the ball gains too much spin and thus flies into a trajectory that is too high, which is detrimental to flight performance. With a Shore D hardness of more than 55, the ball becomes less durable against hitting and somewhat loses spin receptivity and control. The intermediate layer is formed of a thermoplastic elastomer or a mixture of a thermoplastic elastomer and an ionomer resin. Although the thermoplastic elastomers used herein include polyester elastomers and amide elastomers, the use of thermoplastic polyester elastomers is best suited in the practice of the invention.

The thermoplastic polyester elastomers are polyether ester multi-block copolymers which are synthesized from terephthalic acid, 1,4-butane diol, and polytetramethylene glycol (PTMG) or polypropylene glycol (PPG) so that the polybutylene terephthalate (PBT) portion forms hard segments and the polytetramethylene glycol (PTGM) or polypropylene glycol (PPG) forms soft segments. For example, Hytrel 4047, G3548W, 4767, and 5577 are commercially available from Toray-duPont K.K.

Examples of the ionomer resin which can be mixed with the thermoplastic elastomer include relatively high repulsion Himilan 1605 and 1707 commercially available from Mitsui-duPont Polychemical K.K. Usually 0 to 70 parts by weight of the ionomer resin is mixed with 100 parts by weight of the thermoplastic elastomer.

In addition to the thermoplastic elastomer and ionomer resin, the composition of which the intermediate layer is formed may further contain gravity adjusters, for example, inorganic fillers such as zinc oxide and barium sulfate, coloring agents such as titanium dioxide, and other additives.

Preferably the intermediate layer 2 has a radial thickness of 0.5 to 3.0 mm, more preferably 0.6 to 2.7 mm and a specific gravity of at least 1.05, preferably 1.07 to 1.4. A thickness of less than 0.5 mm would be too thin for the intermediate layer to exert its softness, resulting in a low spin rate upon iron shots. With a thickness of more than 3.0 mm, restitution would be lost to detract from flight performance.

The cover 3 preferably has a radial thickness of 1.0 to 3.0 mm, more preferably 1.1 to 2.7 mm. A cover of less than 1.0 mm thick would lower the durability characteristic of solid golf balls. A cover of more than 3 mm thick would be low in repulsion. The cover should have a Shore D hardness of 45 to 58, preferably 45 to 54, most preferably 46 to 53. With a Shore D hardness of less than 45, the ball is less repulsive and gains too much spin. A Shore D hardness of more than 58 would detract from spin receptivity. The cover preferably has a specific gravity of 0.9 to 1.0, especially 0.92 to 0.99.

In order that the invention be effective, the cover is made soft, but not too soft in a sense that the cover hardness is higher than the hardness of the intermediate layer. Preferably the intermediate layer is softer than the cover by a hardness difference of 2 to 20, especially 5 to 15 on Shore D. A smaller hardness difference would detract from spin properties upon iron shots. With a larger hardness difference, the ball would be less repulsive and gain too much spin.

The cover 3 may be formed mainly of an ionomer resin which is conventionally used as the cover of solid golf balls. Exemplary ionomer resins are Himilan 1605 and 1706 commercially available from Mitsui-duPont Polychemical K.K. and Surlyn 8120 and 8320 commercially available from E.I. dupont. Known additives such as pigments, dispersants, anti-oxidants, UV absorbers, UV stabilizers, and plasticizers may be blended in the ionomer resin(s), if desired.

The golf ball of the invention preferably has a distortion of 2.0 to 6.0 mm, especially 2.2 to 5.5 mm under a load of 100 kg.

The center core may be formed of any desired material by any desired method. Any of well-known materials may be used for the core insofar as a golf ball with desirable properties is obtained.

More particularly, the center core of the solid golf ball according to the invention is formed by a conventional technique while properly adjusting vulcanizing conditions and formulation. Usually the core is formed of a composition comprising a base rubber, a crosslinking agent, a co-crosslinking agent, and an inert filler. As mentioned previously, the base rubber may be selected from natural rubber and synthetic rubbers with the preferred base rubber being 1,4-polybutadiene having at least 40% of cis-structure. The crosslinking agent is typically selected from organic peroxides such as dicumyl peroxide and di-t-butyl peroxide, especially dicumyl peroxide. About 0.5 to 1.0 part by weight of the crosslinking agent is blended with 100 parts by weight of the base rubber. The co-crosslinking agent is typically selected from metal salts of unsaturated fatty acids, inter alia, zinc and magnesium salts of unsaturated fatty acids having 3 to 8 carbon atoms (e.g., acrylic acid and methacrylic acid) though not limited thereto. Zinc acrylate is especially preferred. About 10 to 50 parts by weight, preferably about 20 to 48 parts by weight of the co-crosslinking agent is blended with 100 parts by weight of the base rubber. Examples of the inert filler include zinc oxide, barium sulfate, silica, calcium carbonate, and zinc carbonate, with zinc oxide and barium sulfate being often used. The amount of the filler blended is preferably 10 to about 30 parts by weight per 100 parts by weight of the base rubber although the amount largely varies with the specific gravity of the core and cover, the weight of the ball, and other factors. In the practice of the invention, the amount of the filler (typically zinc oxide and barium sulfate) is properly selected so as to provide the desired hardness to the center core.

A core-forming composition is prepared by kneading the above-mentioned components in a conventional mixer such as a Banbury mixer and roll mill, and it is compression or injection molded in a core mold. The molding is then cured by heating at a sufficient temperature for the crosslinking agent and co-crosslinking agent to function (for example, a temperature of about 130° to 170° C. for a combination of dicumyl peroxide as the crosslinking agent and zinc acrylate as the co-crosslinking agent), obtaining a center core.

The intermediate layer is formed from a composition based on a thermoplastic polyester elastomer as mentioned previously. It may be formed on the center core by compression molding or injection molding.

The cover is formed of a composition based on an ionomer resin, as mentioned previously. The cover composition may be molded over the intermediate layer by any desired method, for example, by surrounding the intermediate layer by a pair of preformed hemispherical cups followed by heat compression molding or by injection molding the cover composition over the intermediate layer.

Like conventional golf balls, the golf ball of the invention is formed with a multiplicity of dimples in the cover surface. The geometrical arrangement of dimples may be octahedral, icosahedral or the like while the dimple pattern may be selected from square, hexagon, pentagon, and triangle patterns.

The golf ball of the invention is prepared in accordance with the Rules of Golf, that is, to a diameter of at least 42.67 mm and a weight of not greater than 45.93 grams.

EXAMPLE

Examples of the present invention are given below by way of illustration and not by way of limitation.

Examples and Comparative Examples

Using a center core, intermediate layer, and cover having the composition shown in Table 1, three-piece solid golf balls (Examples 1–6, Comparative Examples 1–2) were prepared which had the parameters and test properties shown in Table 2. Note that a commercially available wound balata golf ball was used as Comparative Example 3.

The center core was prepared by kneading the respective components in a roll mill and pressure molding at 155° C. for 15 minutes. The intermediate layer was formed by injection molding so as to enclose the outer surface of the center core. She cover was formed around the intermediate layer by injection molding, completing the solid golf balls.

TABLE 1

| | E1 | E2 | E3 | E4 | E5 | E6 | CE1 | CE2 |
|---|---|---|---|---|---|---|---|---|
| Center core | | | | | | | | |
| Cis-1,4-poly-butadiene | 100 | 100 | 100 | 100 | 100 | 100 | 100 | 100 |
| Zinc acrylate | 35 | 35 | 35 | 35 | 35 | 30 | 29 | 30 |
| Zinc oxide | 5 | 5 | 5 | 5 | 5 | 5 | 5 | 5 |
| Antioxidant | 0.2 | 0.2 | 0.2 | 0.2 | 0.2 | 0.2 | 0.2 | 0.2 |
| Dicumyl peroxide | 0.9 | 0.9 | 0.9 | 0.9 | 0.9 | 0.9 | 0.9 | 0.9 |
| Barium sulfate | 10.9 | 10.8 | 10.6 | 9.3 | 11.8 | 9.3 | 12.5 | 18.8 |
| Intermediate layer | | | | | | | | |
| Hytrel 4047 | 100 | 100 | 100 | — | — | 100 | — | — |
| Hytrel 4767 | — | — | — | 100 | — | — | — | — |
| Hytrel G3548W | — | — | — | — | 100 | — | — | — |
| Hytrel 8122 | — | — | — | — | — | — | 100 | — |
| Himilan 1605 | — | — | — | — | — | — | — | 50 |
| Himilan 1706 | — | — | — | — | — | — | — | 50 |
| Cover | | | | | | | | |
| Himilan 1605 | 10 | 20 | 10 | 10 | 10 | 10 | 50 | 10 |
| Himilan 1706 | 50 | 50 | 50 | 50 | 50 | 50 | 50 | 50 |

TABLE 1-continued

| | E1 | E2 | E3 | E4 | E5 | E6 | CE1 | CE2 |
|---|---|---|---|---|---|---|---|---|
| Surlyn 8120 | 40 | 30 | — | 40 | 40 | 40 | — | 40 |
| Surlyn 8320 | — | — | 40 | — | — | — | — | — |

Note: The amounts of components blended are parts by weight and their proportion is independent among the center core, intermediate layer, and cover.

The golf balls were evaluated for flight performance, spin, feel, and durability by the following tests.

Flight

Using a swing robot, the ball was hit with a driver at a head speed of 50 m/s (abbreviated as #W1/HS50) and with No. 6 iron at a head speed of 40 m/sec. (abbreviated as #I6/HS40) to measure a carry.

Spin

The ball was hit with #W1, #I6 and sand wedge (#SW at a head speed of 19 m/sec.). Photographs of the ball immediately after impact were analyzed to examine the behavior of the ball. A spin rate was calculated from the image analysis.

Feel

Three professional golfers evaluated a feel on impact using #W1, #I6, #SW, and putter (#PT). The ball was rated "O" for a soft feel, "Δ" for a somewhat hard feel, and "X" for a hard feel.

Indestructibility

Using a flywheel hitting machine, the ball was repeatedly hit at a head speed of 38 m/sec. until the ball was destroyed. With the number of hits counted, the ball was rated "O" for highly indestructible ball, "Δ" for ordinary indestructibility, and "X" for rather destructible ball.

Cover durability

Using a swing robot, the ball was hit at its top with an iron (PW) at a head speed of 38 m/sec. The cover was rated "O" for highly durable cover, "Δ" for ordinary durability, and "X" for less durable cover.

TABLE 2

| | E1 | E2 | E3 | E4 | E5 | E6 | CE1 | CE2 | CE3 |
|---|---|---|---|---|---|---|---|---|---|
| Center core | | | | | | | | | |
| Diameter, mm | 36.5 | 36.5 | 37.1 | 36.6 | 37.1 | 36.5 | 35.5 | 36.5 | commercially |
| Hardness @ 100 kg, mm | 2.9 | 2.9 | 2.9 | 2.9 | 2.9 | 3.6 | 3.7 | 3.6 | available |
| Intermediate layer | | | | | | | | | wound |
| Gage, mm | 1.6 | 1.6 | 1.3 | 1.6 | 1.3 | 1.6 | 1.6 | 1.6 | balata |
| Hardness, Shore D | 40 | 40 | 40 | 47 | 33 | 40 | 30 | 65 | golf ball |
| Specific gravity | 1.12 | 1.12 | 1.12 | 1.15 | 1.09 | 1.15 | 1.15 | 0.97 | |
| Cover | | | | | | | | | |
| Gage, mm | 1.5 | 1.5 | 1.5 | 1.5 | 1.5 | 1.5 | 2.0 | 1.5 | |
| Hardness, Shore D | 53 | 55 | 47 | 53 | 53 | 53 | 66 | 53 | |
| Specific gravity | 0.97 | 0.97 | 0.97 | 0.97 | 0.97 | 0.97 | 0.97 | 0.97 | |
| Ball | | | | | | | | | |
| Outer diameter, rpm | 42.70 | 42.70 | 42.70 | 42.70 | 42.70 | 42.70 | 42.70 | 42.70 | 42.70 |
| Weight, g | 45.30 | 45.30 | 45.30 | 45.30 | 45.30 | 45.30 | 45.30 | 45.30 | 45.30 |
| Hardness @ 100 kg, mm | 2.8 | 2.7 | 2.9 | 2.6 | 3.0 | 3.2 | 2.8 | 2.5 | 2.8 |
| Initial velocity, m/sec. | 77.00 | 77.20 | 76.80 | 76.90 | 76.80 | 76.80 | 77.20 | 77.15 | 76.60 |
| #W1/HS50 | | | | | | | | | |
| Spin, rpm | 2982 | 2891 | 3206 | 2732 | 3184 | 2650 | 2550 | 2588 | 3331 |
| Carry, m | 236.5 | 237.2 | 234.8 | 236.9 | 235.2 | 236.6 | 237.8 | 237.5 | 234.3 |
| Total, m | 246.2 | 246.7 | 244.3 | 246.4 | 244.9 | 246.3 | 247.1 | 246.9 | 243.4 |

TABLE 2-continued

| | E1 | E2 | E3 | E4 | E5 | E6 | CE1 | CE2 | CE3 |
|---|---|---|---|---|---|---|---|---|---|
| #I6/HS40 | | | | | | | | | |
| Spin, rpm | 7273 | 7107 | 7879 | 7121 | 7562 | 6925 | 6015 | 6320 | 7376 |
| Carry, m | 181.0 | 181.3 | 180.1 | 180.8 | 180.3 | 180.9 | 183.0 | 182.3 | 180.0 |
| Total, m | 183.4 | 184.0 | 181.8 | 183.6 | 182.3 | 183.8 | 188.7 | 186.6 | 182.5 |
| Run, m | 2.4 | 2.7 | 1.7 | 2.8 | 2.0 | 2.9 | 5.7 | 4.3 | 2.5 |
| Feel | ○ | ○ | ○ | ○ | ○ | ○ | ○ | ○ | ○ |
| #SW/HS19 | | | | | | | | | |
| Spin, rpm | 6294 | 6063 | 6634 | 6111 | 6163 | 6228 | 4115 | 6068 | 6340 |
| Feel | ○ | ○ | ○ | ○ | ○ | ○ | Δ | X | ○ |
| #PT Feel | ○ | ○ | ○ | ○ | ○ | ○ | X | X | ○ |
| Indestructibility | ○ | ○ | ○ | ○ | ○ | ○ | ○ | ○ | X |
| Cover durability | ○ | ○ | ○ | ○ | ○ | ○ | ○ | X | X |

As is evident from Table 2, the three-piece solid golf balls of the present invention are improved in spin, especially upon iron shots, controllability, durability, and hitting feel while maintaining satisfactory flight performance.

There has been described a three-piece solid golf ball which has spin receptivity approximate to wound golf balls, thus gains appropriate spin even upon iron shots and is improved in controllability while maintaining superior flight and durability characteristic of solid golf balls.

Although some preferred embodiments have been described, many modifications and variations may be made thereto in the light of the above teachings. It is therefore to be understood that within the scope of the appended claims, the invention may be practiced otherwise than as specifically described.

We claim:

1. A three-piece solid golf ball comprising a center core composed mainly of a base rubber, an intermediate layer around the center core formed mainly of a thermoplastic polyester elastomer to a Shore D hardness of 30 to 55, and a cover around the intermediate layer formed mainly of an ionomer resin to a Shore D hardness of 45 to 54.

2. The three-piece solid golf ball of claim 1 wherein said intermediate layer has a specific gravity of at least 1.05 and a thickness of 0.5 to 3.0 mm.

3. The three-piece solid golf ball of claim 1 wherein said cover has a thickness of 1.0 to 3.0 mm.

4. The three-piece solid golf ball of claim 1 wherein said intermediate layer is softer than said cover by a hardness difference of 2 to 20 Shore D.

5. The three-piece solid golf ball of claim 1 wherein said center core has a distortion of 2.0 to 5.0 mm under a load of 100 kg and a diameter of 30 to 41 mm.

6. The three-piece solid golf ball of claim 1 wherein said intermediate layer has a specific gravity in the range of 1.07–1.4.

7. The three-piece solid golf ball of claim 1 wherein said cover has a specific gravity in the range of 0.9 to 1.0.

8. The three-piece solid golf ball of claim 1 wherein said golf ball has a distortion of 2.0 to 6.0 mm under a load of 100 kg.

9. The three-piece solid golf ball of claim 1 wherein said intermediate layer is formed of a mixture of a thermoplastic elastomer and an ionomer resin.

10. The three-piece solid golf ball of claim 1 wherein said core is formed of 1,4-polybutadiene rubber having at least 40% of cis structure.

* * * * *